US009044800B2

(12) United States Patent
Johnson et al.

(10) Patent No.: US 9,044,800 B2
(45) Date of Patent: Jun. 2, 2015

(54) HIGH ASPECT RATIO PARTS OF BULK METALLIC GLASS AND METHODS OF MANUFACTURING THEREOF

(75) Inventors: William L. Johnson, San Marino, CA (US); Marios D. Demetriou, Los Angeles, CA (US); Joseph P. Schramm, Albany, CA (US); Georg Kaltenboeck, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 13/223,134

(22) Filed: Aug. 31, 2011

(65) Prior Publication Data

US 2012/0103478 A1 May 3, 2012

Related U.S. Application Data

(60) Provisional application No. 61/378,859, filed on Aug. 31, 2010.

(51) Int. Cl.

| | |
|---|---|
| ***C22F 1/00*** | (2006.01) |
| ***B21D 22/02*** | (2006.01) |
| ***C22C 45/00*** | (2006.01) |

(52) U.S. Cl.

CPC ..... *B21D 22/022* (2013.01); *C22C 45/00* (2013.01); *C22F 1/00* (2013.01)

(58) Field of Classification Search

CPC ..... C22F 1/00
USPC ..... 148/403, 561
See application file for complete search history.

(56) References Cited

U.S. PATENT DOCUMENTS

| | | | |
|---|---|---|---|
| 5,288,344 | A | 2/1994 | Peker et al. |
| 5,306,463 | A | 4/1994 | Horimura |
| 5,324,368 | A | 6/1994 | Masumoto et al. |
| 5,567,251 | A | 10/1996 | Peker et al. |
| 5,711,363 | A | 1/1998 | Scruggs et al. |
| 5,886,254 | A | 3/1999 | Chi |
| 5,896,642 | A | 4/1999 | Peker et al. |
| 5,950,704 | A | 9/1999 | Johnson et al. |
| 6,027,586 | A | 2/2000 | Masumoto et al. |
| 6,325,868 | B1 | 12/2001 | Kim et al. |
| 6,771,490 | B2 | 8/2004 | Peker et al. |
| 7,017,645 | B2 | 3/2006 | Johnson et al. |

(Continued)

FOREIGN PATENT DOCUMENTS

| | | |
|---|---|---|
| CN | 1202402 | 12/1998 |
| CN | 1436109 | 8/2003 |

(Continued)

OTHER PUBLICATIONS

Yavari et al. "Shaping of Bulk Metallic Glasses by Simultaneous Application of Electrical Current and Low Stress." Mat. Res. Soc. Symp. Proc. vol. 644. 2001.*

(Continued)

*Primary Examiner* — Brian Walck
(74) *Attorney, Agent, or Firm* — Polsinelli PC

(57) ABSTRACT

Bulk metallic articles having a high-aspect ratio that are formed of bulk metallic glass, that are net-shaped and that are produced under process conditions that maximize the quality and integrity of the parts as well as the life of the mold tool, thus minimizing production costs, and manufacturing methods for producing such articles are provided.

19 Claims, 15 Drawing Sheets

(56) References Cited

U.S. PATENT DOCUMENTS

| | | | | |
|---|---|---|---|---|
| 7,794,553 | B2 | 9/2010 | Duan et al. | |
| 2007/0003782 | A1 * | 1/2007 | Collier | 428/621 |
| 2008/0099175 | A1 | 5/2008 | Chu et al. | |
| 2009/0236017 | A1 | 9/2009 | Johnson et al. | |

FOREIGN PATENT DOCUMENTS

| | | |
|---|---|---|
| CN | 1486800 | 4/2004 |
| CN | 1735948 | 2/2006 |
| CN | 101543885 | 9/2009 |
| JP | 2006-505143 | 2/2006 |
| KR | 10-2004-00893980 | 10/2004 |
| WO | WO 2005/034590 | 4/2005 |
| WO | WO 2009/117735 | 9/2009 |

OTHER PUBLICATIONS

International Search Report dated Apr. 9, 2012, PCT/US2011/050064, 3 pages.

Hays et al., "Microstructure Controlled Shear Band Pattern Formation and Enhanced Plasticity of Bulk Metallic Glasses Containing in situ Formed Ductile Phase Dendrite Dispersions," Physical Review Letters, 2000, vol. 84, pp. 2901-2904.

Inoue et al., "Bulk amorphous alloys with high mechanical strength and good soft magnetic properties in Fe—TM—B (TM=IV-VII group transition metal) system," Applied Physics Letters, 1997, vol. 71, pp. 464-466.

Lee et al., "Kinetics of crystallization in continuously cooled BMG," Materials Science and Engineering, 2005, vol. A404, pp. 153-158.

Masuhr et al., "Time Scales for Viscous Flow, Atomic Transport, and Crystallization in the Liquid and Supercooled Liquid States of $Zr_{41.2}Ti_{13.8}Cu_{12.5}Ni_{10.0}Be_{22.5}$," Physical Review Letters, 1999, vol. 82, No. 11, pp. 2290-2293.

Mattern et al., "Structural behavior and glass transition of bulk metallic glasses," Journal of Non-Crystalline Solids, 2004, 345&346, pp. 758-761.

Mukherjee et al., "Noncontact measurement of high-temperature surface tension and viscosity of bulk metallic glass-forming alloys using the drop oscillation technique," Applied Physics Letters, 2005, vol. 86, 014104, 3 pages.

Pan et al., "A numerical study on the breakup process of laminar liquid jets into a gas," Physics of Fluids, 2006, vol. 18, 052101, 11 pages.

Schroers, "Processing of Bulk Metallic Glass," Advanced Materials, 2009, vol. 21, pp. 1-32.

Schroers et al., "Pronounced asymmetry in the crystallization behavior during constant heating and cooling of a bulk metallic glass-forming liquid," Physical Review., 1999, vol. 60, pp. 11-855-11-858.

Shen et al., "Bulk Glassy Alloy $Co_{43}$ $Fe_{20}$ $Ta_{5.5}$ $B_{31.45}$ with High Glass-Forming Ability and Good Soft Magnetic Properties" Mater. Trans., The Japan Institute of Metals, 2001, vol. 42, No. 10, pp. 2136-2139.

Wiest et al., "Injection molding metallic glass," Scripta Materialia, 2009, vol. 60, pp. 160-163.

Wang et al., "Characteristics of the glass transition and supercooled liquid state of the $Zr_{41}Ti_{14}Cu_{12.5}Ni_{10}Be_{22.5}$ bulk metallic glass," The American Physical Society, 2001, Physical Review B, vol. 63, 052204, 4 pages.

* cited by examiner

Prior Art

HIGH ASPECT RATIO PARTS OF BULK METALLIC GLASS AND METHODS OF MANUFACTURING THEREOF

CROSS-REFERENCE TO RELATED APPLICATIONS

The current application claims priority to U.S. Provisional Application No. 61/378,859, filed, Aug. 31, 2010, the disclosure of which is incorporated herein by reference.

FIELD OF THE INVENTION

The present invention relates generally to articles formed from bulk metallic glass, and more particularly to parts made from bulk metallic glass having high aspect ratio.

BACKGROUND OF THE INVENTION

A long-recognized challenge in manufacturing metallic parts is how to form high-precision/high aspect ratio (i.e., an article having a high ratio of length to thickness) structural and mechanical parts in an economical manner. The reason these types of articles are particularly difficult to manufacture is that, because they are intended for use as a mechanical or structural component, they need adequate strength, stiffness, and toughness to perform. But because they have a high aspect ratio, that is, their thickness is small in comparison to their length, the demands placed on the material performance and fabrication capability are very high.

Although there are many industries for which high-aspect ratio structural parts are required, one obvious example is the consumer electronic (CE) industry. CE manufacturers must produce products such as cellular phones, laptop computers, digital cameras, PDA's, televisions, that are generally comprised of integrated circuits, displays, and digital storage media, and which are packaged in a casing that often includes frame assemblies, and complex functional components such as hinges, slider bars, or other hardware with both mechanical and structural functions, as shown for example in FIG. 1. In addition, the consumer-driven demand for increasingly smaller CE products places a demand for increasingly thinner structural components (e.g. casings and frames) with increasingly larger aspects ratios and better mechanical performance.

Today, such casings, frames, and structural components are fabricated primarily from metal alloys or plastics. Plastics parts are generally very inexpensive owing to low raw material cost and cost efficient manufacturing processes. From a manufacturing perspective, plastics are easy to form into complex three dimensional net shapes with high precision and tolerance, excellent surface finish, and desirable cosmetic appearance. There are a number of excellent high-volume production techniques, such as, for example, injection molding, blow molding, and other thermoplastic forming methods that are highly efficient and cost effective at the typical temperatures (100-400° C.) and pressures (10-100 MPa) required for processing plastics. The low manufacturing cost of plastic hardware is driven partly by the low cost-processing requirements of net-shaped plastic parts. But, a significant fraction of the manufacturing cost savings in plastics processing arises from the very high mold-tool life. The exceptionally low processing pressures and temperatures give rise to remarkably high tool life, typically in the millions of cycles, thereby significantly reducing the mold-tool overhead cost per part. On the other hand, plastics have limited stiffness (elastic modulus), relatively low strength and hardness, and have limited toughness and damage tolerance. As a result, plastic parts are often a poor choice when mechanical performance is of importance as in many structural applications. For example, casing and frames made of plastics are highly susceptible to fracture on bending or impact, scratch and wear, and provide only limited rigidity and stability as a structural framework.

In contrast, metals and metal alloys have much higher stiffness and rigidity, strength, hardness, toughness, impact resistance, and damage tolerance which make them a superior choice for structural applications for precision parts with high aspect ratio. However, precision net-shape metal hardware is typically made either by casting, die forming/forging, or machining. For example, die casting with permanent (multiple use) mold took is often used to fabricate high volume low cost metal hardware, but is restricted to relatively low melting point alloys (melting temperatures less than 700° C.) such as aluminum, magnesium, zinc, etc. This is because typical tool-steel molds are often tempered at temperatures below 700° C., and processing above the tempering temperature will rapidly deteriorate the mold. Typical tool life in die casting of low-melting point metal alloys are on the order of hundreds of millions of cycles, that is, roughly one order of magnitude lower than in plastics processing. For more refractory, higher stiffness/strength alloys having higher melting temperatures such as steel and titanium alloys, the die casting melt temperatures (often >1500 C) far exceed the typical working temperature of steel tooling. Moreover, the die casting pressures required to cast net shapes are generally high (tens or hundreds of MPa). Consequently, tool life becomes a major cost limiting issue. Moreover, in die casting of metal alloys, the melt viscosities are very low (typically in the range of $10^{-5}$ to $10^{-3}$ Pa-s), and thus the melt flow is characterized by high flow inertia and limited flow stability. Consequently, the mold tool is rapidly filled by molten metal moving at high velocities (typically >1 m/s) and the metal is often atomized and sprayed into the mold creating flow lines, cosmetic defects, and a final part of limited quality and integrity. Accordingly, die casting is not commercially viable for titanium alloys, steels, or other refractory metal alloys.

As a result, when precision, complex net-shaped, high quality, high aspect ratio refractory metal hardware is required for structural applications in consumer electronic frames, casings, and structural parts, most manufacturers resort to machining the components. While machining steel and titanium alloys, for example, can meet the functional, cosmetic, and performance requirements for these high-aspect ratio electronic casings and frames, it is time intensive, inefficient, leads to large material waste, and results in very costly hardware. Accordingly, there is a growing need in the consumer electronics industry to produce high precision structural hardware with a material that matches or bests the stiffness, strength, toughness, hardness, and overall mechanical performance of refractory metals using an efficient cost effective process technology competitive with that currently used to manufacture plastic hardware.

SUMMARY OF THE INVENTION

The present invention is directed to amorphous structural metal articles and methods of making thereof that are bulk, have a high aspect ratio and are substantially free of defects.

In another embodiment the invention is directed to a method of manufacturing an amorphous structural metal article that includes:

providing a blank from a bulk metallic glass;

heating the blank from the glass state to a processing temperature above the crystallization temperature, $T_x$, but below the melting temperature, $T_m$, of the bulk-solidifying amorphous alloy;

applying a shaping pressure to the blank in a shaping tool to form an amorphous metallic article having a high aspect ratio and dimensions in all axes of at least 0.5 mm; and quenching the article at a cooling rate sufficient to ensure that the article retains an amorphous phase.

In one such embodiment, the processing temperature is such that the viscosity of the bulk metallic glass is between 1 and $10^5$ Pa-s.

In another such embodiment, the bulk metallic glass is heated to a processing temperature where the product of the flow Weber number and the flow Reynolds number is less than one.

In still another such embodiment, the processing temperature is from between 400 and 750° C.

In yet another such embodiment, the processing temperature is at least 100 degrees above the glass-transition temperature, $T_g$, and is at least 100 degrees below the glass-transition temperature, $T_m$, of the bulk-solidifying amorphous alloy.

In still yet another such embodiment, the heating is performed at a heating rate in excess of the critical heating rate of the bulk metallic glass.

In still yet another such embodiment, the heating rate is at least 100° C./s.

In still yet another such embodiment, the shaping pressure is no greater 100 MPa.

In still yet another such embodiment, the shaping pressure is from 10 to 50 MPa.

In still yet another such embodiment, the flow velocity of the bulk metallic glass into the shaping tool is less than 1 m/s.

In still yet another such embodiment, the shaped article comprises at least one geometric feature having a tolerance of 0.1 mm.

In still yet another such embodiment, the entire shaping step occurs in less than 50 ms.

In still yet another such embodiment, the article has dimensions in all axes of at least 1 mm.

In still yet another such embodiment, the processing temperature is at least 50° C. lower than the tempering temperature of the shaping tool.

In still yet another such embodiment, the shaping tool has a cycle life of at least $10^6$ shaped articles.

In still yet another such embodiment, the outer surface of the article is formed free of visible defects.

In still yet another such embodiment, the selection of the bulk metallic glass is independent of $\Delta T$.

In still yet another such embodiment, the bulk metallic glass is selected from the group consisting of metallic glass forming alloys Ti-based, Cu-based, Zr-based, Au-based, Pd-based, Pt-based, Ni-based, Co-based, and Fe-based alloys.

In still yet another such embodiment, the article is in the form of an electronics case for a device selected from the group of: cellular phone, PDA, portable computer, and digital camera.

In still yet another such embodiment, the heating occurs through a rapid discharge of electrical current through the blank In still yet another such embodiment, the article is made in net-shape such that no substantial post-processing is required.

In still yet another such embodiment, the article is formed substantially free of defects including at least one of the group consisting of flow lines, gas inclusions, foreign debris and roughening.

The invention is also directed to articles made from the process embodiments described above.

BRIEF DESCRIPTION OF THE DRAWINGS

These and other features and advantages of the present invention will be better understood by reference to the following detailed description when considered in conjunction with the accompanying drawings and data, wherein.

DETAILED DESCRIPTION OF THE INVENTION

Figure 1:
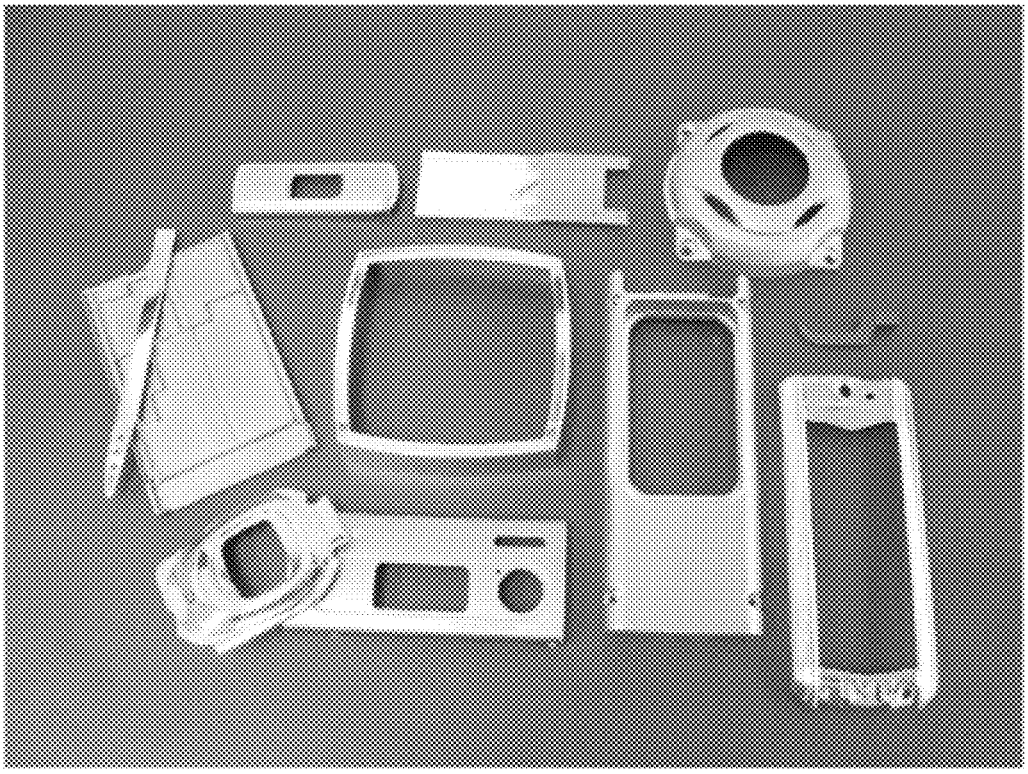
FIG. 1 provides a picture of exemplary CE device casings (taken from J. Schroers, *Adv. Mater.* 21; 1-32 (2009), the disclosure of which is incorporated herein by reference)

The person skilled in the art will recognize that additional embodiments according to the invention are contemplated as being within the scope of the foregoing generic disclosure, and no disclaimer is in any way intended by the foregoing, non-limiting examples.

Articles manufactured from metal can be characterized in accordance with a number of different criteria both related to their function and also to their means and method of manufacture, such as, size, shape, thickness, length, complexity, etc. And, based on the selection of material and manufacturing method, different aspects becoming limiting factors. One of the key limiting factors for the manufacture of high precision parts with a high aspect ratio is finding a combination of a material and a cost-effective manufacturing method capable of efficiently creating such parts on an industrial scale. Bulk metallic glasses (BMGs) have recently emerged as attractive candidate materials for such applications, owing to a mechanical performance superior to typical engineering metals, and a fabrication capability that has many parallels to the processing of plastics. Specifically, they have been identified as combining a number of physical characteristics (strength, toughness, elastic limit) that are ideal for high-precision, high aspect ratio parts that serve a structural and/or mechanical function. Unfortunately, thus far a suitable manufacturing method for BMG materials has not been identified for producing these types of articles. In particular, the current techniques available for forming such high-precision, high aspect ratio parts from BMG are expensive, inefficient, and prone to creating final parts with unacceptable levels of manufacturing defects.

The present invention is directed to high-precision net-shape articles having low thickness and high-aspect ratio that are formed from bulk metallic glasses at processing conditions that are optimal for high volume manufacturing, and that are substantially free of manufacturing defects such as flow lines, cellularization and roughening, and manufacturing methods for producing such articles.

Definitions

A "bulk metallic article" is, for the purpose of this invention, an article that has dimensions in all axes of at least 0.5 mm and retains an amorphous phase.

"Amorphous" is, for the purpose of this invention, any material that comprises at least 50% amorphous phase by volume, preferably at least 80% amorphous phase by volume, and most preferably at least 90% amorphous phase by volume as determined by any of the following techniques: X-ray diffraction, scanning electron microscopy, transmission electron microscopy, and differential scanning calorimetry.

A "high-aspect ratio" is, for the purpose of this invention, an article having a ratio of length to thickness in at least one dimension of around or above 100 ("high aspect ratio").

"Net-shape" is, for purposes of this invention, an article that is formed with mostly complete geometrical features in the initial shaping step of manufacture without the need for substantial post-processing steps, such as, for example, machining, grinding, smoothing or polishing.

"High-precision" or "complex" are, for the purposes of this invention, an article that has structural elements that require tolerances on the order of not more than 0.1 mm.

"Glass-transition temperature", denoted by $T_g$, is, for the purpose of this invention, the temperature designating the onset of relaxation when the as-cast metallic glass is heated at a rate of 20 degrees per minute.

"Crystallization temperature", denoted by $T_x$, is, for the purpose of this invention, the temperature designating the onset of crystallization when the as-cast metallic glass is heated at a rate of 20 degrees per minute.

"Melting temperature", denoted by $T_m$, is, for the purpose of this invention, the liquidus temperature of the bulk-solidifying amorphous alloy.

Overview of Bulk Metallic Glasses

Bulk metallic glasses (BMG's) are a class of high strength metal alloys that have mechanical performance (strength, elasticity, hardness) comparable or superior to Ti-alloys and steels, and that allow for the fabrication of bulk parts, i.e., parts having dimensions greater than 0.5 mm in all axes that can be used in structural elements where specific strength, specific modulus, and elastic limit are key figures of merit. To understand why this is important, one should appreciate that the resistance of a metallic glass to crystallization can be related to the cooling rate required to bypass crystallization and form the glass upon cooling from the melt (critical cooling rate). It is desirable that the critical cooling rate be on the order of not more than $10^3$ K/s, or preferably 1 K/s or less. As the critical cooling rate decreases, the dimensional constraints on the heat removal rate are relaxed such that larger cross sections of parts with an amorphous phase can be fabricated.

The critical casting thickness can be formally related to the critical cooling rate of the alloy using Fourier heat flow equations. For example, if no latent heat due to crystallization is involved, the average cooling rate R at the center of a solidifying liquid is approximately proportional to the inverse square of the smallest mold dimension L, i.e., $R \approx \alpha L^{-2}$ (L in cm; R in K/s), where the factor $\alpha$ is related to the thermal diffusivity and the freezing temperature of the liquid (e.g., $\alpha \sim 15$ K-cm$^2$/s for Vitreloy 1 $Zr_{41.2}Ti_{13.8}Cu_{12.5}Ni_{10}Be_{22.5}$ glass). Hence, the cooling rates associated with the formation of a 0.5 mm cast strip using Vitreloy 1 would be on the order of $10^3 \sim 10^4$ K/s.

Although one example of a bulk metallic glass is described above, over the past twenty years any number of bulk metallic glass compositions have been discovered. (See, e.g., U.S. Pat. Nos. 5,288,344; 6,325,868, A. Inoue et al., Appl. Phys. Lett., Volume 71, p 464 (1997); Shen et al., Mater. Trans., JIM, Volume 42, p 2136 (2001); and Japanese patent application 2000126277 (Publ. #0.2001303218 A); and C. C. Hays et al., Physical. Review Letters, Vol. 84, p 2901, (2000), all of which are incorporated herein by reference.) In addition to these monolithic bulk metallic glasses, a number of composite bulk metallic glass materials that incorporate particulate reinforcements such as, for example, SiC, diamond, carbon fiber and metals such as Molybdenum, or have a dendritic phase reinforcement, have also been discovered. (See, e.g., U.S. Pat. Nos. 5,886,254 and 5,567,251, the disclosures of which are incorporated herein by reference.) It should be understood that in the context of the current application, any of these bulk metallic glass compositions may be used to form the bulk, high-aspect ratio parts disclosed herein.

Conventional Methods of Manufacture

Figure 2:
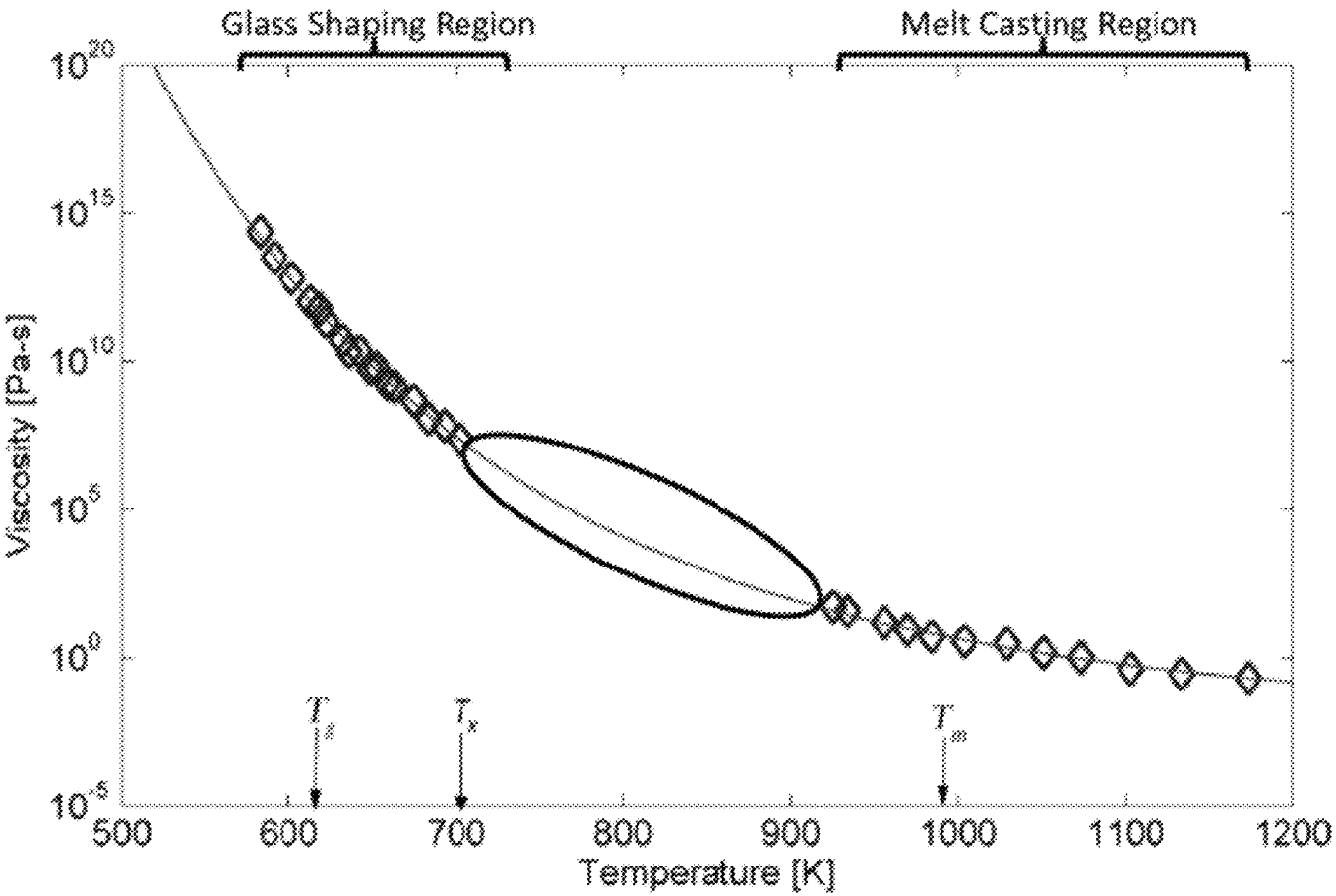
FIG. 2 provides a data graph showing a plot of viscosity vs. temperature for the Vitreloy-1 bulk metallic glass (data in the glass-shaping region taken from Masuhr et al. *Phys. Rev. Lett.* 82, 2290-2293 (1999); data in the melt casting region taken from Mukherjee et al. *Appl. Phys. Lett.* 86, 014104 (2005), the disclosures of which are incorporated herein by reference)

Almost without exception, bulk metallic glasses (BMG) have a very predictable dependence between temperature and viscosity. An exemplary plot of such dependence is shown in FIG. 2 for the Vitreloy 1 BMG material. Two interesting phenomena can be observed in this curve. First, the viscosity of the BMG drops about 15 orders of magnitude from the glass (below $T_g$) to the melt (above $T_m$), which means that the forming conditions (pressure and time) required to shape a BMG depends critically on the temperature under which the BMG is formed. The second interesting observation that can be made is that there are two regions that are accessible along this curve where is possible to conduct flow experiments and measure the viscosity of the BMG: one between $T_g$ and $T_x$, and one above and just below the melting temperature ($T_m$).

Naturally, this curve also defines the two windows in which BMGs can be conventionally processed, namely, the "glass shaping region" and the "melt casting region". Two basic methods of processing BMGs have been developed based on these different windows: 1) processing from the melt upon cooling, and processing from glass via heating into the super-cooled liquid region. (Examples of conventional techniques based on these basic methods are described in U.S. Pat. Nos. 7,794,553; 7,017,645; 6,027,586; 5,950,704; 5,896,642; 5,711,363; 5,324,368; 5,306,463, the disclosures of which are incorporated herein by reference.) However, all of these methods have serious deficiencies that result in serious limitations on the type and geometry of articles that can be formed, the quality and integrity of the articles formed therefrom, and the favorability of processing conditions. These deficiencies will be described in greater detail below.

Conventional Melt Casting

Die casting has been used to fabricate high performance electronic casings and functional components from BMG's in the "melt casting region," shown in FIG. 2. (See, e.g., U.S. Pat. No. 5,306,463, cited above.) In the die casting process, the BMG alloy is melted (at temperatures typically 200-500° C. above the liquidus temperature, which for Vitreloy 1 correspond to 900-1200° C.), poured into a shot sleeve, and injected at high velocities (several meters/s) under typical pressures of 100 to 500 MPa into a permanent mold-tool cavity. This technique has been, and continues to be, the incumbent method for producing complex high aspect ratio parts, such as, for example, cell phone cases, hinges, brackets, and other functional components for consumer electronics products. However, the BMG hardware produced by die casting is typically characterized by defects and cosmetic flaws, casting yields are relatively poor, and substantial post-processing is typically required. More importantly, as the processing melt temperature is substantially higher than 700° C., which represents the upper limit of operating temperatures for a typical tool steel, mold tool life is relatively poor (typically on the order of thousands of cycles for a typical tool-steel mold tool). The result of all these problems Row yield, substantial post-processing operations, and low mold-tool life) is that the parts made by die-casting are expensive.

Figure 3:
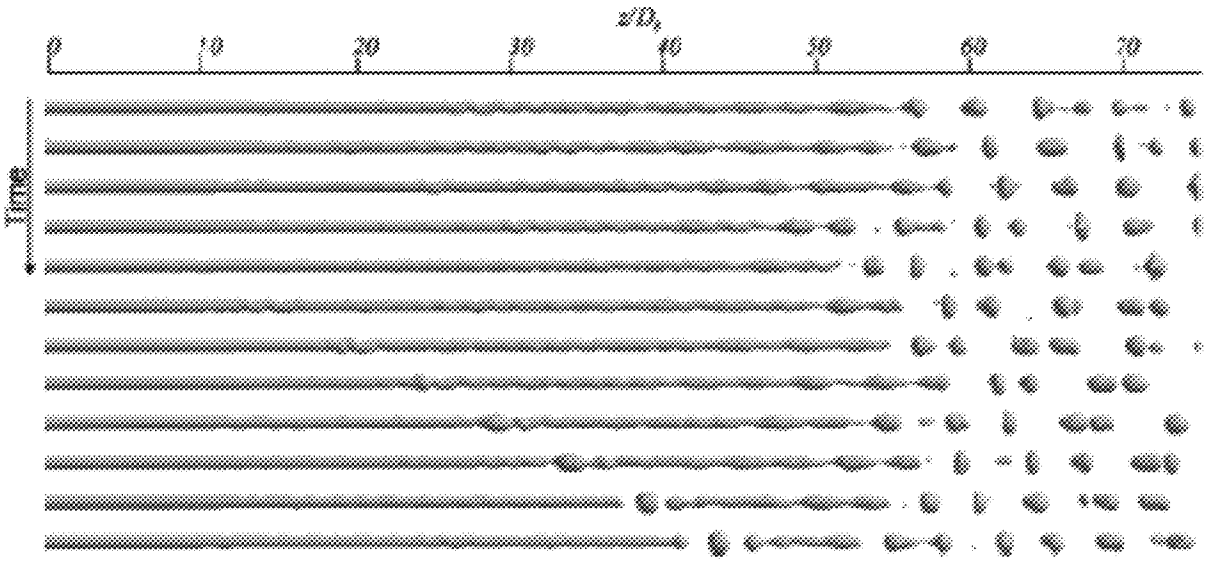
FIG. 3 provides a plot showing Laminar flow break up (taken from Pan & Suga, *Phys. Fluids,* 18, 052101 (2006), the disclosure of which is incorporated herein by reference)

The origin for these shortcomings can be understood by examining the processing conditions that must be met to ensure the part is adequately formed and retains an amorphous phase when processed in the "melt casting region". The first, and most problematic issue, is the consistent formation of casting defects (such as cellularization, roughening, and flow lines) that form in articles, and particularly high aspect ratio articles, during melt casting of BMG materials. The reason for the formation of these defects is directly related to the flow conditions required to process the melt, such as by die casting. As shown in FIG. 3, defects in die-cast articles result from break-up of the laminar flow of the BMG melt into the die. Whether the flow of a BMG into a die will remain laminar and stable can be predicted by two fundamental dimensional numbers characterizing the flow: 1) the Weber number (We), which scales inertial forces to surface tension, and is given by:

$$We = \frac{\rho V^2}{\sigma / L} \quad \text{[EQ. 1]}$$

and, 2) the Reynolds number (Re), which scales inertial forces to viscous forces, and is given by:

$$Re = \frac{\rho V^2}{\eta V / L} \quad \text{[EQ. 2]}$$

where, L is the thickness of the part, V is the flow velocity, ρ is the density, σ is the surface tension, and η is the viscosity. In order to ensure that instabilities do not develop during flow of a liquid into a mold or die, the product of Weber and Reynolds numbers must be less than 1:

$$WeRe<1 \quad \text{(EQ. 3)}$$

In short, EQ. 3 dictates that if the inertial forces of the flow do not overcome the surface tension, flow-front instabilities would not nucleate; and if the inertial forces of the flow do not overcome the viscous forces, flow-front instabilities would not grow. In sum, if flow-front instabilities fail to either nucleate or grow, laminar and stable flow would be ensured.

Using these equations it is possible to calculate the probability of the development of flow instabilities when die-casting a conventional. BMG, such as Vitreloy 1, under standard conditions. The physical conditions for die-casting a 1 mm thick BMG part (L=0.001 m) using Vitreloy 1 are given in Table 1, below.

TABLE 1

| Conditions for Casting Vitreloy 1 | |
|---|---|
| Density (ρ) | 6000 kg/m$^3$ |
| Surface tension (σ) | 1 J/m$^2$ |
| Viscosity (η) | 1 Pa-s |
| Typical Flow Velocity (V) | 5 m/s |

Inserting these values into EQs. 1 and 2, above, yields a Row stability number (WeRe) of ~4500. In short, the problem with die casting is that because of the low viscosity of the BMG alloy, the fluid inertia during injection is large enough overcoming both surface tension and viscous forces even for a relatively thin part. As such, instabilities inevitably develop during the flow resulting in voids, cells, rough spots and flow lines in the final article.

Figure 4:
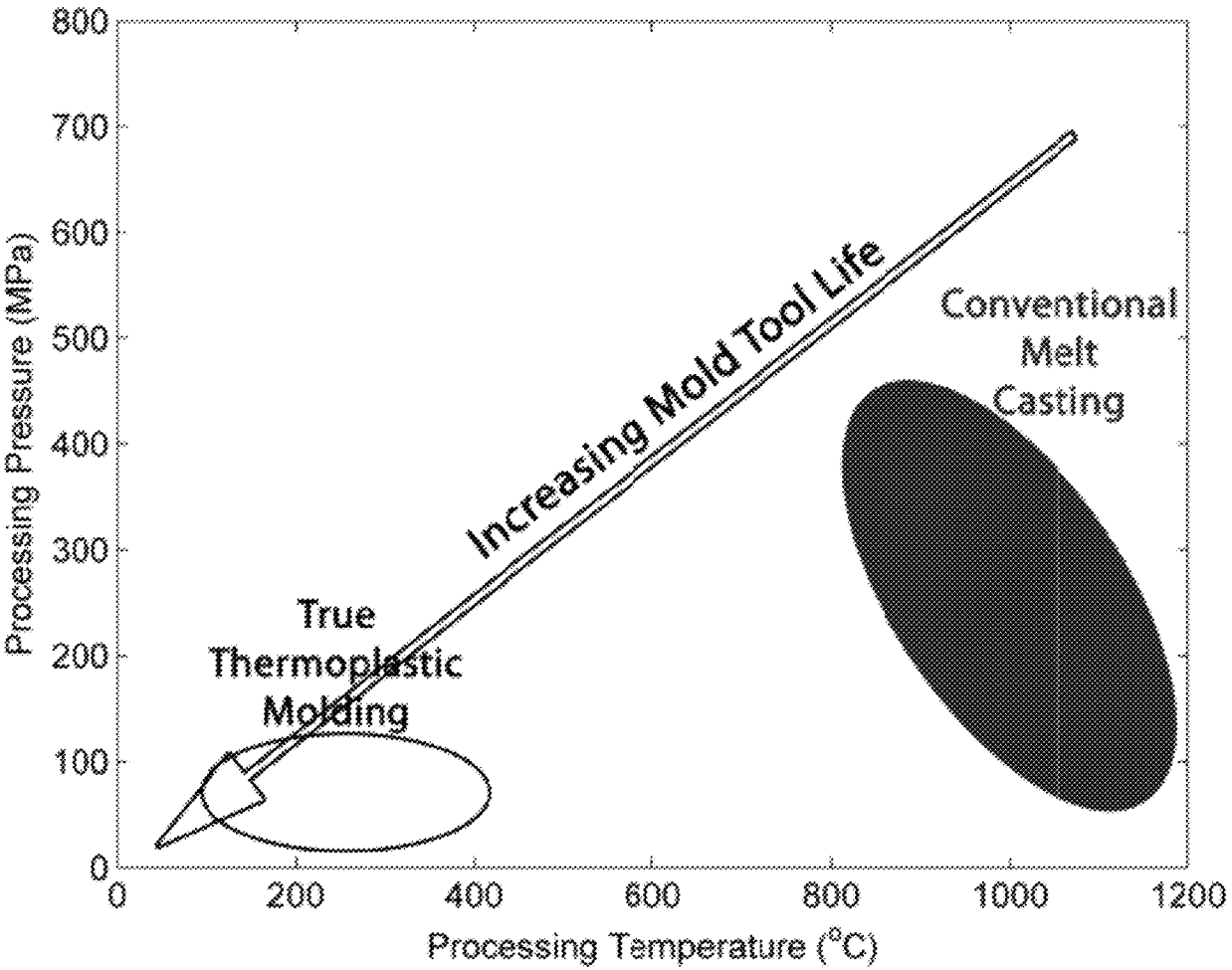
FIG. 4 provides a plot of tool life versus injection pressure and melt temperature for a conventional melt casting technique, and for true thermoplastic molding.

Another problem with die casting BMG is that the temperature and pressures required result in a dramatic decrease in tool life. This is shown graphically in FIG. 4, which shows that tool life increases (in direction of arrow) when the operating temperature and pressure decrease. As seen in the plot, the method that would result in "ideal." mold-tool life is true thermoplastic molding (as performed in plastics processing). The reason for the tool-life dependence on both pressure and temperature is that mold tools are typically made of tool steels that are tempered at a specific temperature, and therefore have an upper limit on casting temperatures at which they are designed to operate. Tempering temperatures of typical tool steels are around 600° C. If these tools are exposed to temperatures that are higher than this operating criterion, or to high pressures, the tool will be damaged and its tool life will be decreased. As seen in FIG. 4, while die casting of BMGs does not require very high pressures, it does require very high temperatures. In particular, while the processing temperatures (melting temperature of typical. BMG materials) are lower than that of steel or Ti-alloys, they are still much higher than the temperatures used in die casting typical. Al—, Mg—, or Zn-alloys (500-700° C.). The result is that die-casting BMG materials can reduce the tool life of a typical tool-steel mold from the millions of cycles realized in the processing of plastics, or hundreds of thousands of cycles realized in the processing of low-melting point metal alloys, to just a few thousand. The very high cost of typical commercial mold tools (typically tens of thousands of US dollars) translates directly into increased manufacturing cost per part (several US dollars per part).

Figure 5:
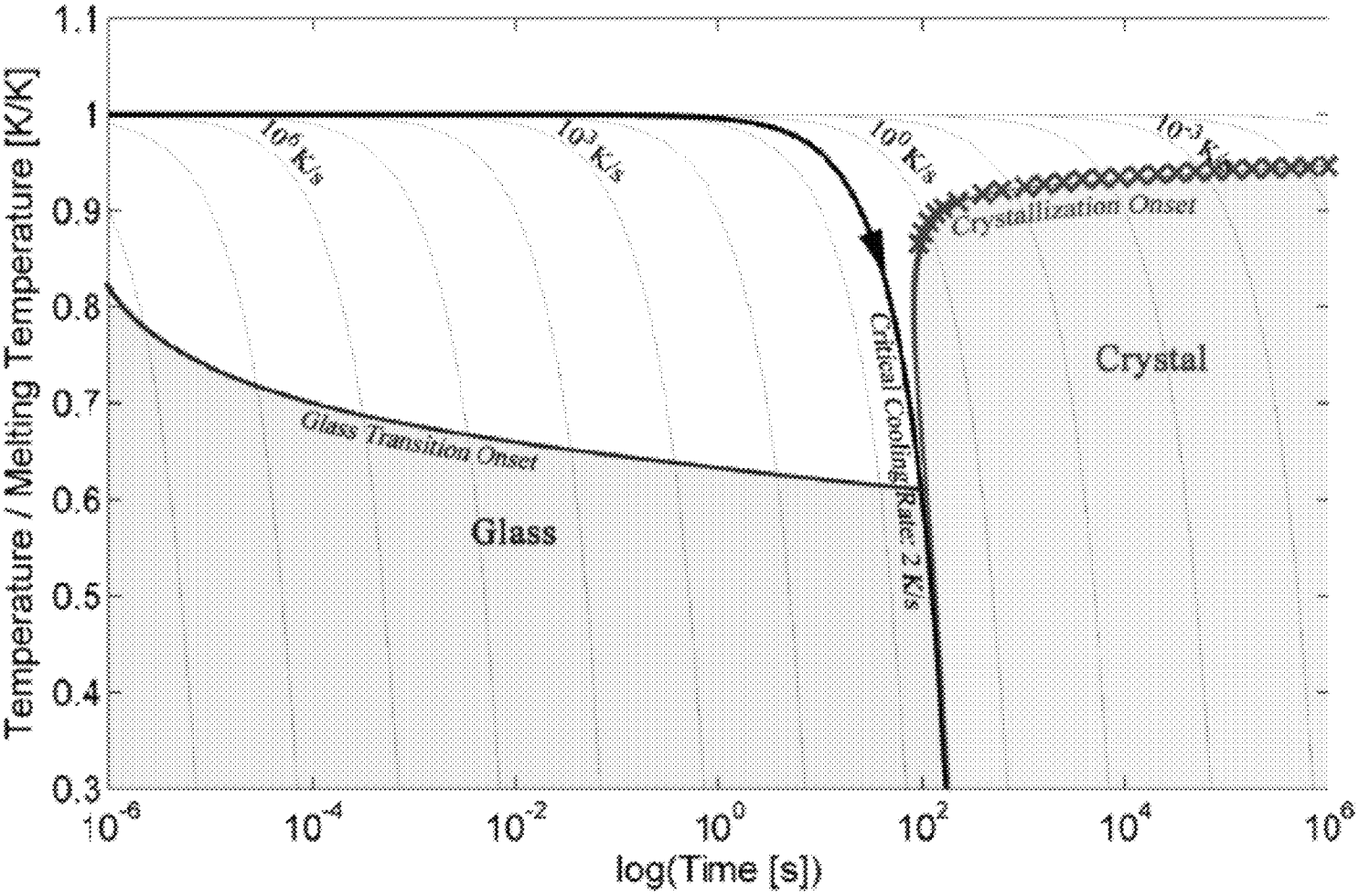
FIG. 5 provides a continuous-cooling-transformation plot (temperature vs. time) for Vitreloy 1 (data taken from S. B. Lee and L. J. Kim *Mater. Sci. Eng. A* 404, 153-158 (2005), the disclosure of which is incorporated herein by reference)

The final problem with using a conventional die-casting process is the processing requirements to render the part amorphous, and is demonstrated by examining the cooling curve of a typical. BMG material. In this case, an exemplary continuous-cooling-transformation curve for Vitreloy 1 is provided in FIG. 5. This plot shows the cooling "path" from the melt if one cools the BMG from the melt continuously (as approximately encountered in die casting of BMG). As seen, below a "critical cooling rate" the alloy will crystallize, but as long as the cooling rate is above this critical rate crystallization will be avoided.

For Vitreloy 1, this requirement states that if the temperature of the melt when already in the cavity is at $T_m$ or higher, the rate of heat removal from the mold should be associated with a cooling rate of about 2 K/s or higher. This will translate to relatively thick parts of thickness of the order of several millimeters. But for a more marginal glass former with a critical cooling rate of order $10^3$ K/s or higher, this requirement will translate to much thinner parts of thickness of a millimeter or less. The result of the critical cooling rate requirement is to severely limit the choice of BMG-alloys to only those with greatest glass forming ability.

Conventional Glass Shaping

On the opposite side of the viscosity curve shown in FIG. 2 is the glass shaping region. In this region, A BMG feedstock material is heated to a glass transition temperature range specific to the material that is between the glass-transition temperature ($T_g$) and its crystallization temperature ($T_x$), and then shaped using a mold or die. (Descriptions of exemplary processes can be found in U.S. Pat. Nos. 6,027,586 and 7,017,645, the disclosures of which are incorporated herein by reference.) This glass shaping process inherently produces better quality parts simply because the viscosity of the BMG is so much higher (8 to 15 orders of magnitude). As a result of this very high viscosity, it would not be feasible for the flow inertia to overcome the enormous viscous forces, thus effectively hindering the growth of any flow instabilities, as discussed above with reference to EQs. 1 to 3. However, although shaping BMGs in the glass forming region solves one of the problems associated with forming in the melt casting region, conventional glass shaping techniques have many of the same issues, including low tool life and restrictive compositional requirements. What is more, a new complexity is introduced, namely that it is difficult to obtain parts with high aspect ratios using physically attainable pressures.

Figure 6:
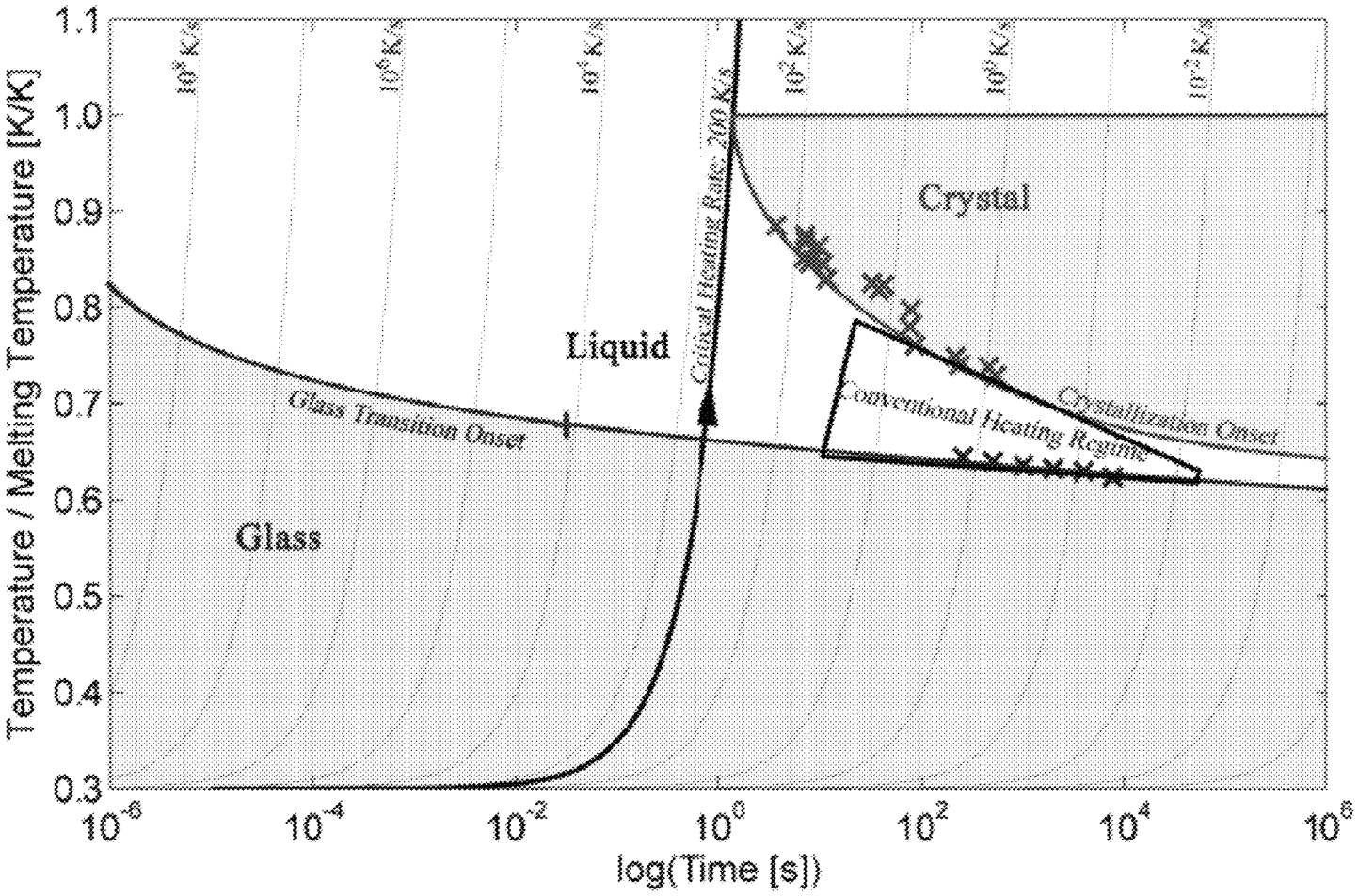
FIG. 6 provides a continuous-heating-transformation plot (temperature vs. time) for Vitreloy 1 (data taken from J. Schroers et al., *Phys. Rev. B* 60 11855-11858 (1999), the disclosure of which is incorporated herein by reference)

To understand these limitations, it is necessary to understand the conditions required for performing glass shaping. A graphical depiction of the temperature zone of this glass forming region is provided in FIG. 6. As seen, the glass feedstock is heated to above $T_g$, between $T_g$ and $T_x$, and then held within that region for forming. First, it should be understood that in principle one could uniformly heat the material fast enough above $T_g$ to avoid crystallization altogether (above 200 K/s for Vitreloy 1, as shown in FIG. 6). However, using conventional heating techniques (e.g. furnace heating, induction heating, laser heating, etc.), in which heat is typically supplied at the boundaries of the material, such instantaneous uniform heating is not feasible. A simple heat flow calculation will show that the edges of the feedstock will heat more rapidly than the center, and this problem is only magnified as the thickness of the feedstock is increased. What is more, if the temperature is not substantially uniform through the feedstock prior to shaping, the viscosity of the feedstock will be highly non-uniform, and therefore the shaping pressure, which may be sufficient for the hot fluid region near the edges, may not be sufficient for the cold viscous region around the center. Consequently, flow and shaping will stall.

Accordingly, in these conventional techniques it is necessary to slowly heat the BMG to ensure a uniform temperature throughout. As a result, as shown in FIG. 6, in these conventional glass-shaping techniques the shaping process will be confined to within a very narrow temperature window between $T_g$ and $T_x$. Within this window, the viscosity drops from $10^{12}$ Pa-s at $T_g$, to $10^6$ or $10^5$ Pa-s at $T_x$, depending on the glass stability against crystallization. The higher the processing temperature within this region, the lower the pressure requirement would be for a given aspect ratio part (i.e. for a given strain). This also means that, as in the case of die-casting, the BMG alloys used must have excellent stability against crystallization so that the difference between $T_g$ and $T_x$ (the $\Delta T$) at these low heating rates is as large as possible. But even at the highest values for $\Delta T$ reported for the most stable BMG alloys, the pressure to form a high aspect ratio part would be considerably higher than the pressure required to process the same part from a plastic material via a true thermoplastic molding method.

Figure 7:
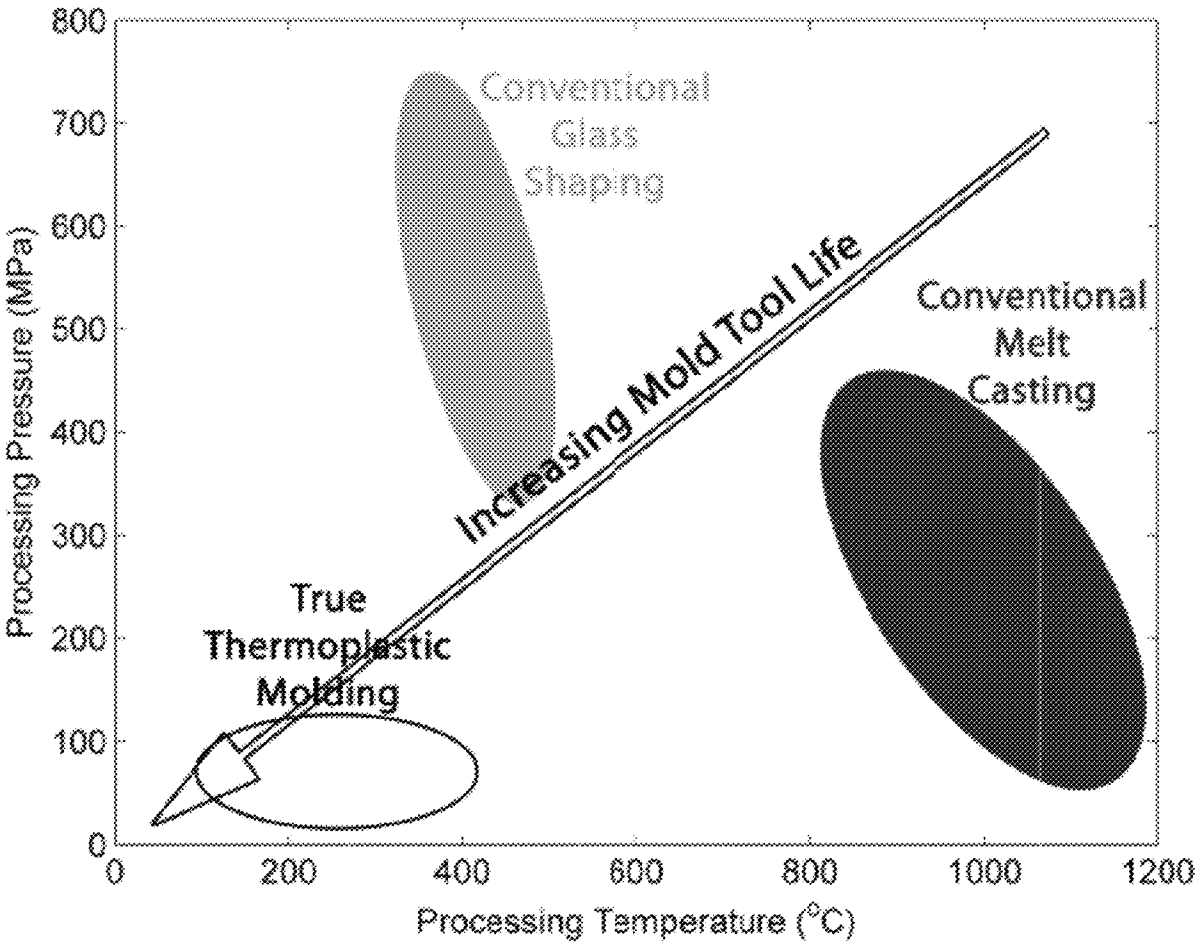
FIG. 7 provides a plot of tool life versus injection pressure and melt temperature for a conventional glass shaping technique, a conventional melt casting technique, and for true thermoplastic molding.

The latter is the reason tool life is shortened and that high aspect ratio parts are difficult, if not impossible, to obtain in the glass shaping regime. It is necessary again to examine the processing conditions required for the technique. In particular, as previously discussed, glass shaping happens at very low temperatures. This in and of itself is beneficial to tool life. However, as shown in FIG. 2, this means that the viscosity of the BMG material is extremely high, which, as shown in FIG. 7, means that the pressure used to inject the BMG into the mold or die must be proportionally higher. These higher injection pressures generate large local stresses on small-scale features of the took (like at corners or fillets) shortening the number of cycles it can perform in its lifetime when compared to a true thermoplastic technique.

Figure 8:
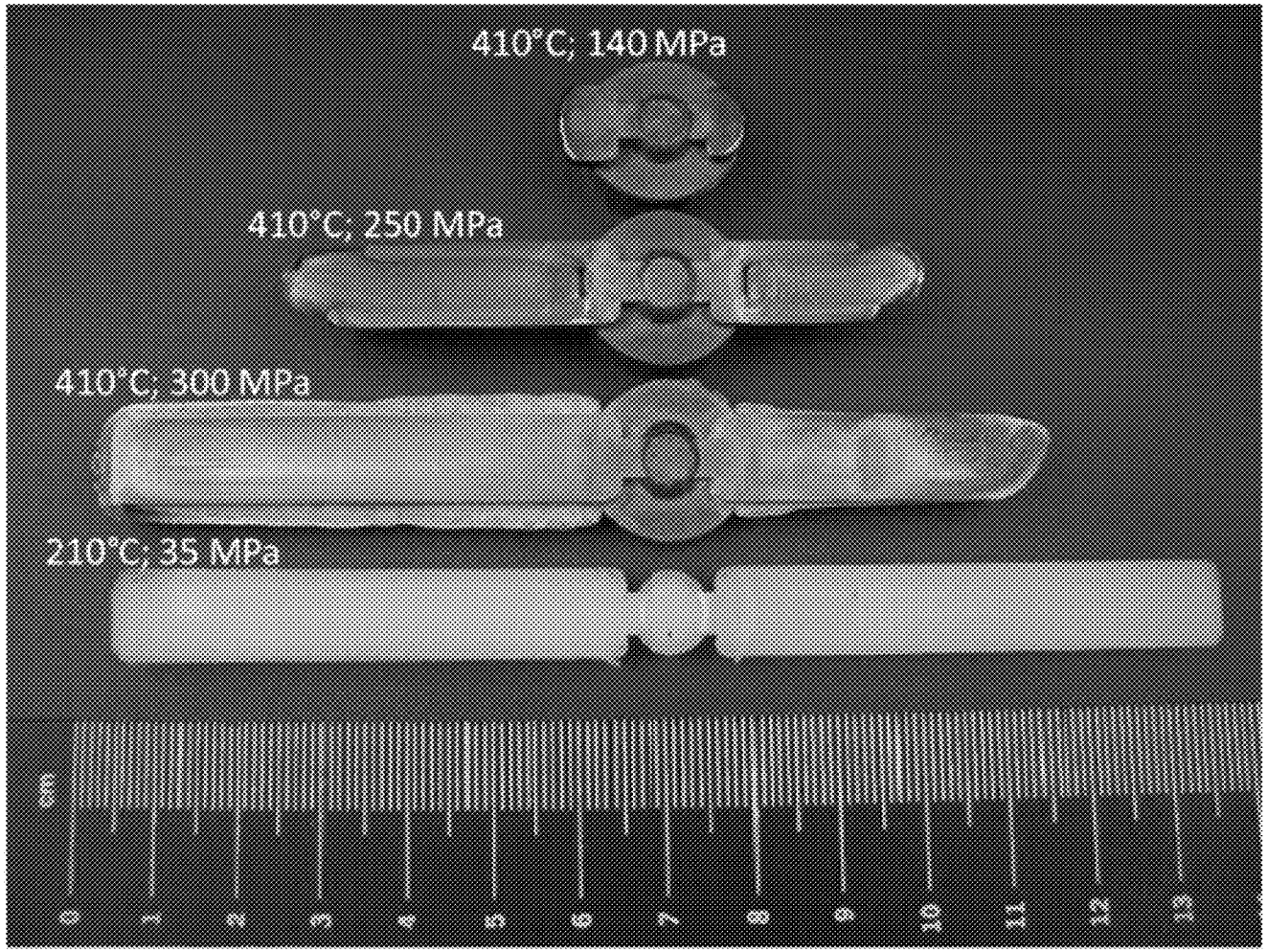
Prior Art FIG. 8
FIG. 8 provides pictures of glass formed parts at different temperatures (taken from Wiest et al., *Scripta Materialia,* 60, 160-63 (2009), the disclosure of which is incorporated herein by reference)

This high viscosity also explains why high aspect ratio parts are so difficult to form using a glass shaping method. In short, to push or move the BMG through the mold in the time period allowed requires higher and higher injection pressures. A graphic demonstration of this is shown in FIG. 8, which is taken from a publication to A. Wiest et al., and demonstrates attempts to duplicate a molded plastic (polypropylene) part processed at a temperature of 210° C. and a pressure of 35 MPa with a BMG material. As seen, conventional glass shaping conditions require about ten times the injection pressure (300 MPa) to even approach a successful duplication of the plastic item, and even then it is not possible to duplicate the full length of that plastic part with the BMG material.

Inventive Technology

The idea of forming complex, bulk, high aspect ratio, net-shape parts, such as electronic cases, from bulk metallic glasses is not new. For example, U.S. Pat. No. 6,771,490, the disclosure of which is incorporated herein by reference, discloses an electronic case formed from a bulk metallic glass having certain elastic properties. It identifies a number of key aspects that a complex device would need to have, including, that such a device would have walls, openings and other support structures, and that these would be of a number, size, shape and nature necessary for the particular application. In that case the focus was on frames for enclosing electronics, such as, for example, data storage and manipulation devices such as PDAs and notebook computers; multimedia recording devices such as digital cameras and video cameras; multimedia players such as CD and DVD players; communications devices such as pagers and cellular phones; etc.

While the art identifies the ideal elastic properties for use in forming electronic cases, it relies on conventional processing techniques. As highlighted in the discussion above, the result is that it misidentifies the principal challenge, both with manufacturing bulk high aspect ratio articles using BMGs and ensuring the quality and integrity of the final parts produced, namely the processing conditions used. In short, the prior art does not recognize the most important challenge in producing bulk, high aspect-ratio, net-shape BMG parts, namely, that to form such parts requires a combination of processing conditions simply unavailable from conventional forming techniques. There is therefore a need to provide a BMG processing technology capable of producing bulk, high aspect-ratio parts inexpensively at commercial volumes, and also to provide BMG parts that have the unique combination of characteristics that include bulk dimensions in all axes, that have a high aspect ratio, and that are net-shaped.

Inventive Process

The prior art identified electronic frame casing as items that would benefit from being manufactured from BMG materials. The "complex", "high aspect ratio" articles of the instant invention certainly encompass such devices, however, the current invention is directed more generally to any complex, high aspect ratio articles, such as, for example, watch cases, dental and medical instruments and implants, circuitry components, fuel cell or other catalytic structures, membranes, etc. In short, the current invention is directed to any bulk structure having a high aspect ratio, and incorporating features that are either of a structural or mechanical nature.

From the above discussion, it is possible to identify the necessary characteristics for a manufacturing process to form such complex, bulk, high-aspect ratio, net-shape parts, Such a technique would combine the following parameters: (1) low processing temperatures (400-750° C.), (2) low shaping pressures (10-50 MPa), (3) moderate melt injection velocities ~1 m/s or less, (4) the ability to process a wide range of BMG alloys including those with modest glass forming ability and small ΔT, (5) and enhanced mold tool life.

Figure 9:
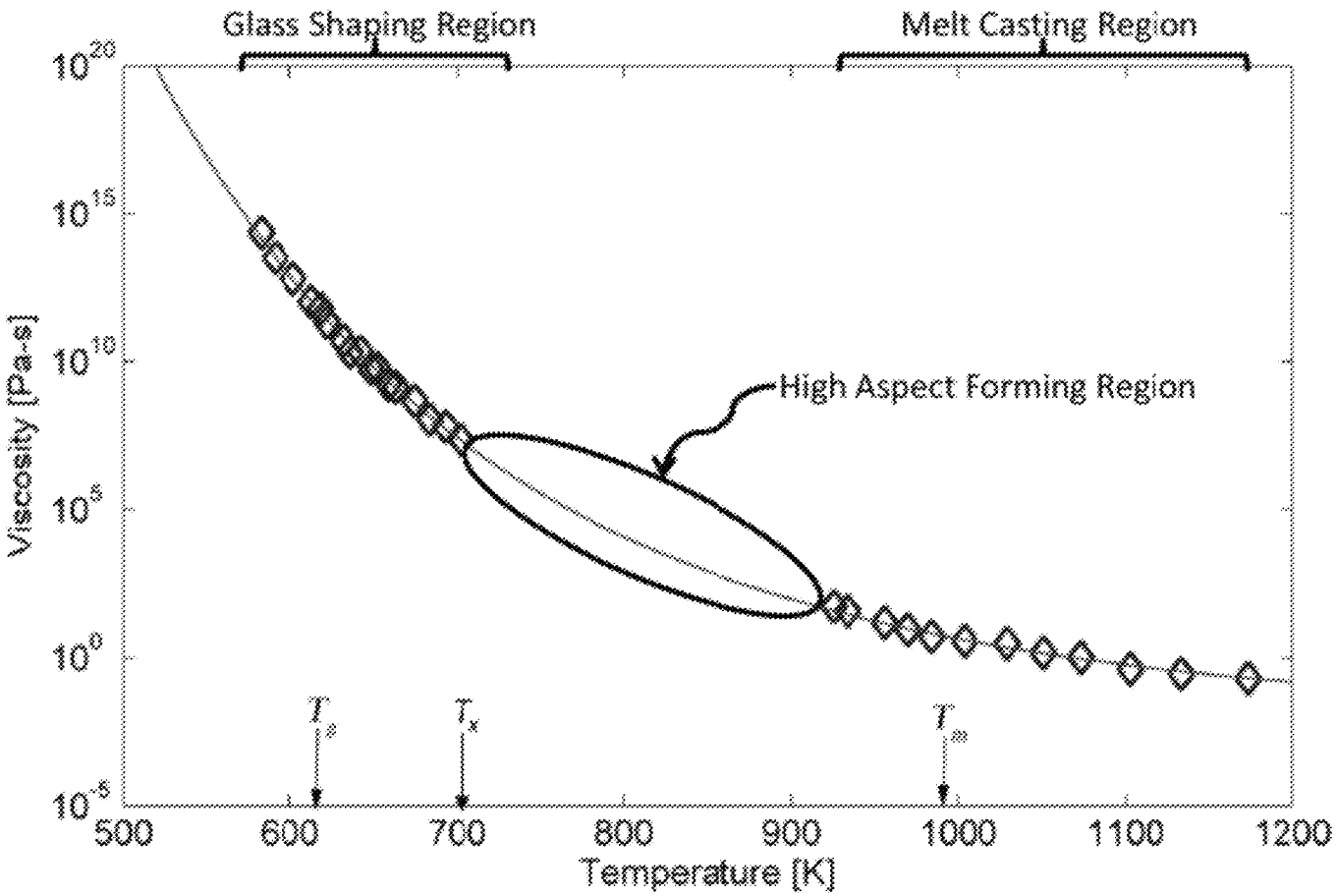
FIG. 9 provides a data graph showing a plot of viscosity vs. temperature for the Vitreloy-1 bulk metallic glass highlighting the high aspect forming region in accordance with the current invention (data in the glass-shaping region taken from Masuhr et al. *Phys. Rev. Lett.* 82, 2290-2293 (1999); data in the melt casting region taken from Mukherjee et al. *Appl. Phys. Lett.* 86, 014104 (2005), the disclosures of which are incorporated herein by reference)

FIG. 9, maps where such a technique would take place on the viscosity vs. temperature curve for Vitreloy 1. As seen, the ideal processing region for forming the bulk, high aspect ratio parts of the current invention lies right in the middle of the curve between the melt casting region and the glass shaping region. At these viscosities, and with small shaping pressures (less than 100 MPa), the flow inertia and specifically the melt velocity will remain low (<1 m/s), such that the flow We and Re will also remain low satisfying the flow stability criterion of EQ. 3. When the parameters for a standard BMG, such as Vitreloy 1 are substituted into EQs. 1 to 3 (see Table 2, below), WeRe for the typical. Vitreloy-1 BMG using such a technique to produce 1 mm thick parts (L=0.001 m) will be less than 1 (WeRe~0.03), indicating that the flow of the BMG will be laminar and stable. Hence, defects common with die-casting will not develop, and formation of highly complex articles with structural or functional mechanical structures having extremely high tolerances will be enabled.

TABLE 2

| Conditions for Inventive High Aspect Ratio (Vitreloy 1) | |
|---|---|
| Density (ρ) | 6000 kg/m$^3$ |
| Surface tension (σ) | 1 J/m$^2$ |
| Viscosity (η) | 10$^3$ Pa-s |
| Typical Flow Velocity (V) | 1 m/s |

Figure 10:
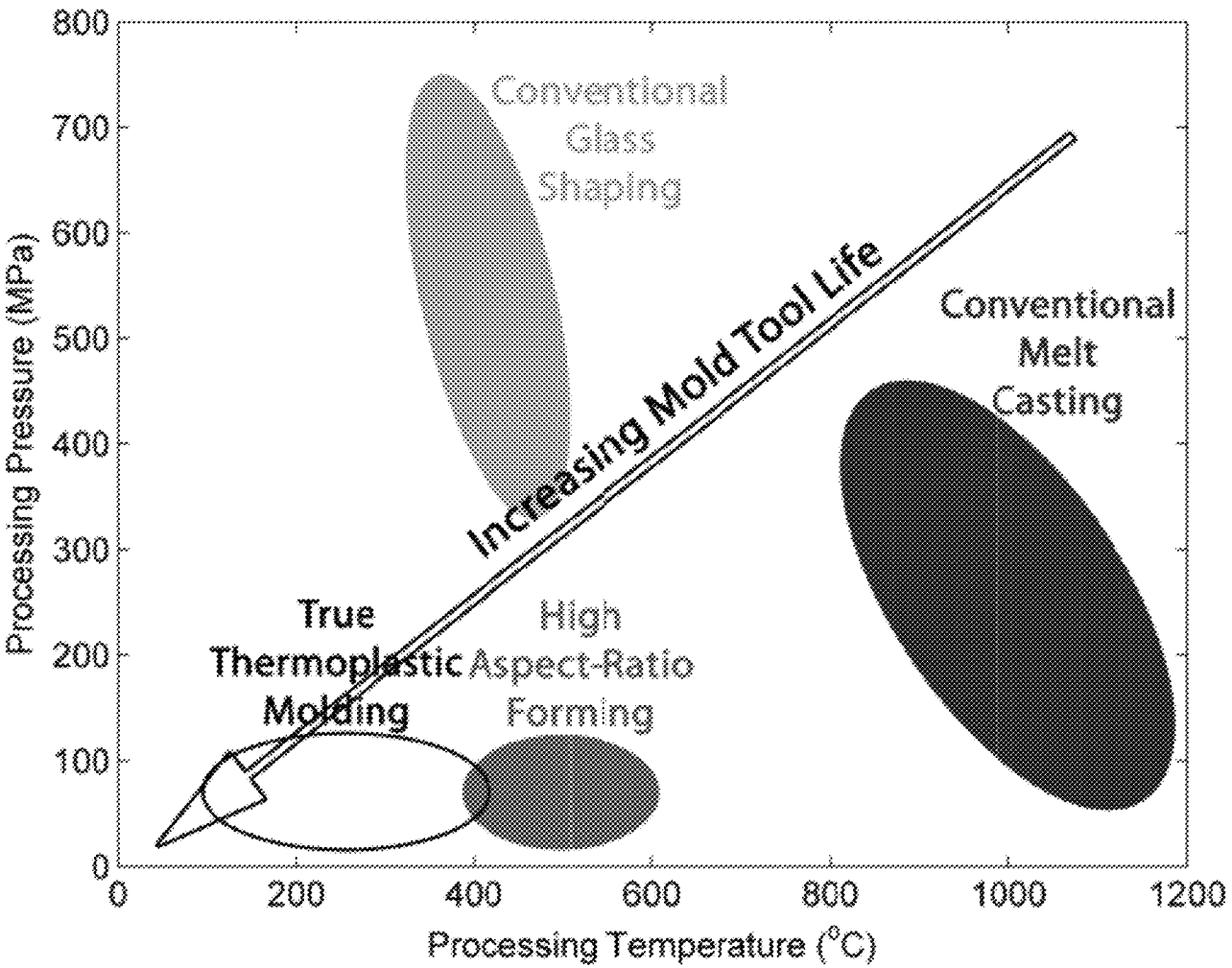
FIG. 10 provides a plot of tool life versus injection pressure and melt temperature for the inventive high aspect ratio forming technique, a conventional glass shaping technique, a conventional melt casting technique, and for true thermoplastic molding.

What is more, when the low injection pressure is taken in combination with the low processing temperatures (typically below 700° C.), the tool life for such a technique would overlap closely the nearly ideal range for true plastic processing (as seen in FIG. 10), both increasing tool life and reducing part costs when compared to conventional techniques.

Figure 11:
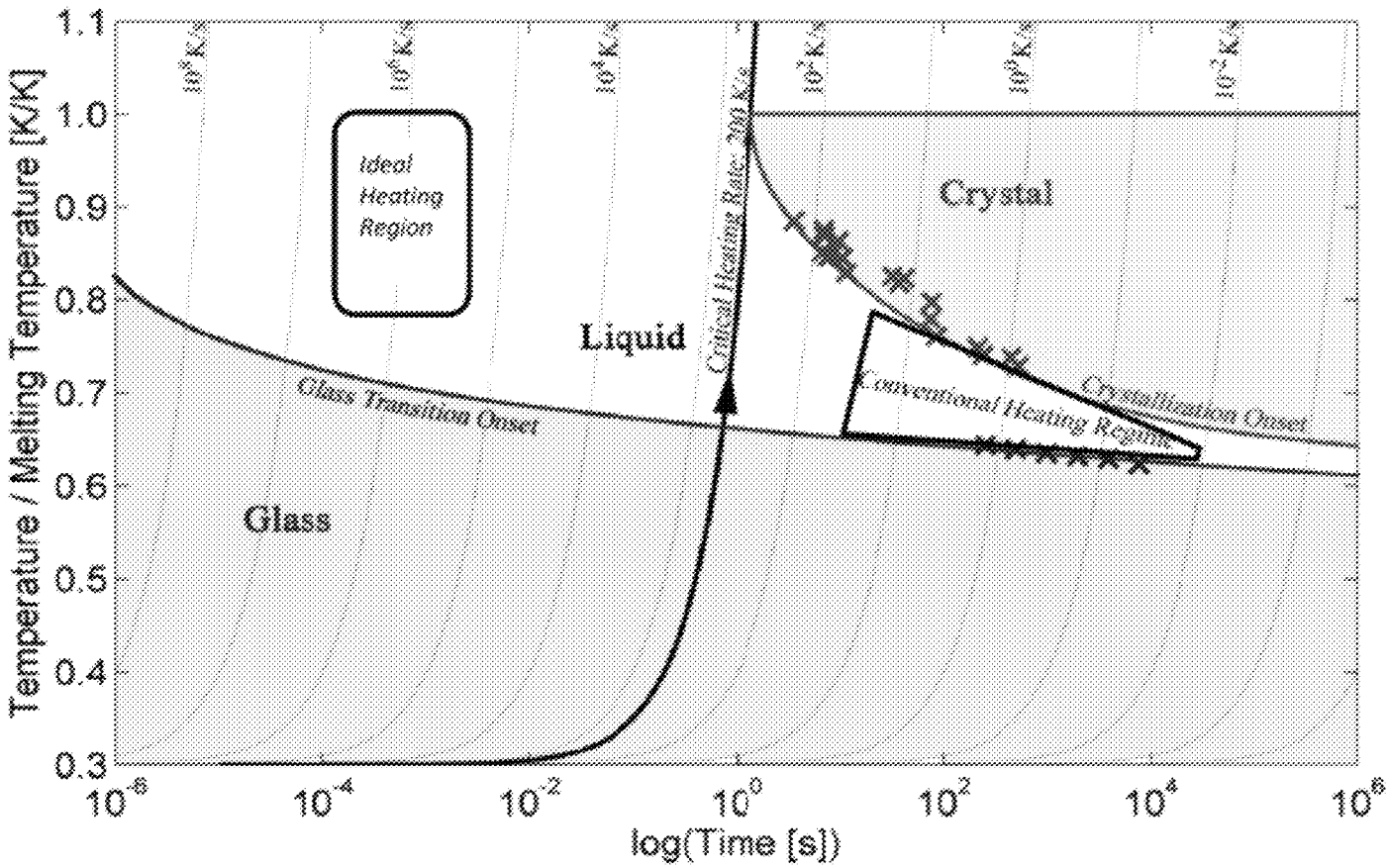
FIG. 11 provides a continuous-heating-transformation plot (temperature vs. time) for Vitreloy 1 (data taken from J. Schroers et al., *Phys. Rev. B* 60 11855-11858 (1999), the disclosure of which is incorporated herein by reference)

Finally, to ensure the ability to form high aspect ratio parts, it would be necessary to avoid crystallization altogether during both the heating and shaping processes. As shown in FIG. 11, at conventional heating rates, the processing temperature window required by this "ideal." system (400 to 750° C.) would be below the melting temperature of the BMG, $T_m$, but above the crystallization temperature, $T_x$. In other words, for any known conventional heating process, this is a forbidden window in which BMGs lose their amorphous phase. In fact, heating a sample to the processing temperatures proposed under conventional heating conditions (rates of 1 to 100 K/s) would result in almost instantaneous crystallization of the sample, as shown in FIG. 11. Accordingly, to prevent this, the ideal high aspect ratio forming method would uniformly heat the sample from a solid to between 400 and 750° C. at a high rate (above 200 K/s for Vitreloy 1), not attainable by conventional means, to avoid the crystallization curve entirely.

In summary, an ideal method of manufacturing bulk, high aspect ratio parts would include the following characteristics:

- stable flow front (WeRe<1);
- high yield (low defect rate);
- low applied pressures (<100 MPa);
- process temperatures below the melt but above the crystallization temperature (~400 to 750° C.);
- extended tool life (>100,000 cycles);
- ultra-rapid heating process (<50 ms); and
- use of any BMG independent of its ΔT value.

It has now been recognized that this unique combination of processing parameters is ideal, and essential, for forming bulk, high-aspect ratio BMG parts that are net-shape. In operation such a method would have at least the following steps:

- Providing a blank of a bulk metallic glass;
- Heating the bulk metallic glass to a temperature above the crystallization temperature, but below the melting temperature of the BMG;
- Applying a shaping pressure for a time sufficient short to avoid crystallization; and
- Cooling the article to below the glass transition temperature at a rate faster than the critical cooling rate of the bulk metallic glass to ensure that the article retains an amorphous phase.

Using these parameters it is possible to avoid all of the manufacturing difficulties, (high injection pressure/high temperature/restrictions to high ΔT materials) associated with conventional melt casting and glass shaping techniques. Moreover, some additional parameters can also be identified to further optimize this high aspect ratio part manufacturing process, including, Applying a shaping pressure of less than 100 MPa; and Heating the BMG to a temperature where the viscosity of the BMG is high enough (e.g., 1 and $10^5$ Pa-s) such that the WeRe of the flow is less than 1;

Heating the BMG to a temperature sufficiently below the tempering temperature of the shaping tool to prevent excessive wear of the tool. (preferably at least 50° C. below the tempering temperature); and Heating the bulk metallic glass at a rate above the critical heating rate of the bulk metallic glass.

Each of these parameters, though optional, further refines the optimal conditions for producing high-precision, high aspect ratio amorphous articles.

Inventive High Aspect Articles

The present invention is also directed to bulk, high aspect, net-shaped BMG articles, such as, for example, electronic frames, casings, hinges, brackets, etc., made from the process described above. The articles of the instant invention, formed in accordance with the above criteria, have a combination of characteristics that were previously unobtainable, including:

They are bulk, which for the purposes of this invention means that they have critical dimensions in all axes of at least 0.5 mm.

They can have a high aspect ratio, which for the purposes of this invention means that they have a ratio of longitudinal length to thickness of around or above 100.

They are amorphous, which for the purposes of this invention means that they have at least 50% amorphous phase by volume, preferably at least 80% amorphous phase by volume, and most preferably at least 90% amorphous phase by volume as determined, for example, by X-Ray diffraction.

They are net-shaped and defect free, which for the purposes of this invention means essentially free of defects such as flow lines, entrained gas inclusions, and foreign debris introduced by melting in crucibles, and requiring minimal post-processing.

They have a high quality cosmetic finish, which for the purposes of this invention means that after manufacture they are free of surface defect visible to the naked eye, and preferably a microscopically mirror smooth finish.

They can be fabricated from a wide variety of bulk metallic glass forming alloys independently of their ΔT value (e.g. Ti-based, Cu-based, Fe-based, etc. BMG alloys)

In summary, the inventive method allow for and the inventive article are of high quality and integrity, complex net-shaped, precision, structural hardware with benchmark mechanical performance, and cosmetic surface finish. Moreover, the low temperatures, pressures, and injection velocities permit fabrication of such hardware while also leading to dramatically enhanced mold-tool life owing to the same low process temperatures, pressures, and injection velocities. As such, it is expected that high aspect ratio parts fabricated in accordance with the current invention will be characterized by low cost, high quality and integrity, excellent precision and tolerances, and high yields.

EXEMPLARY EMBODIMENTS

Figure 12:
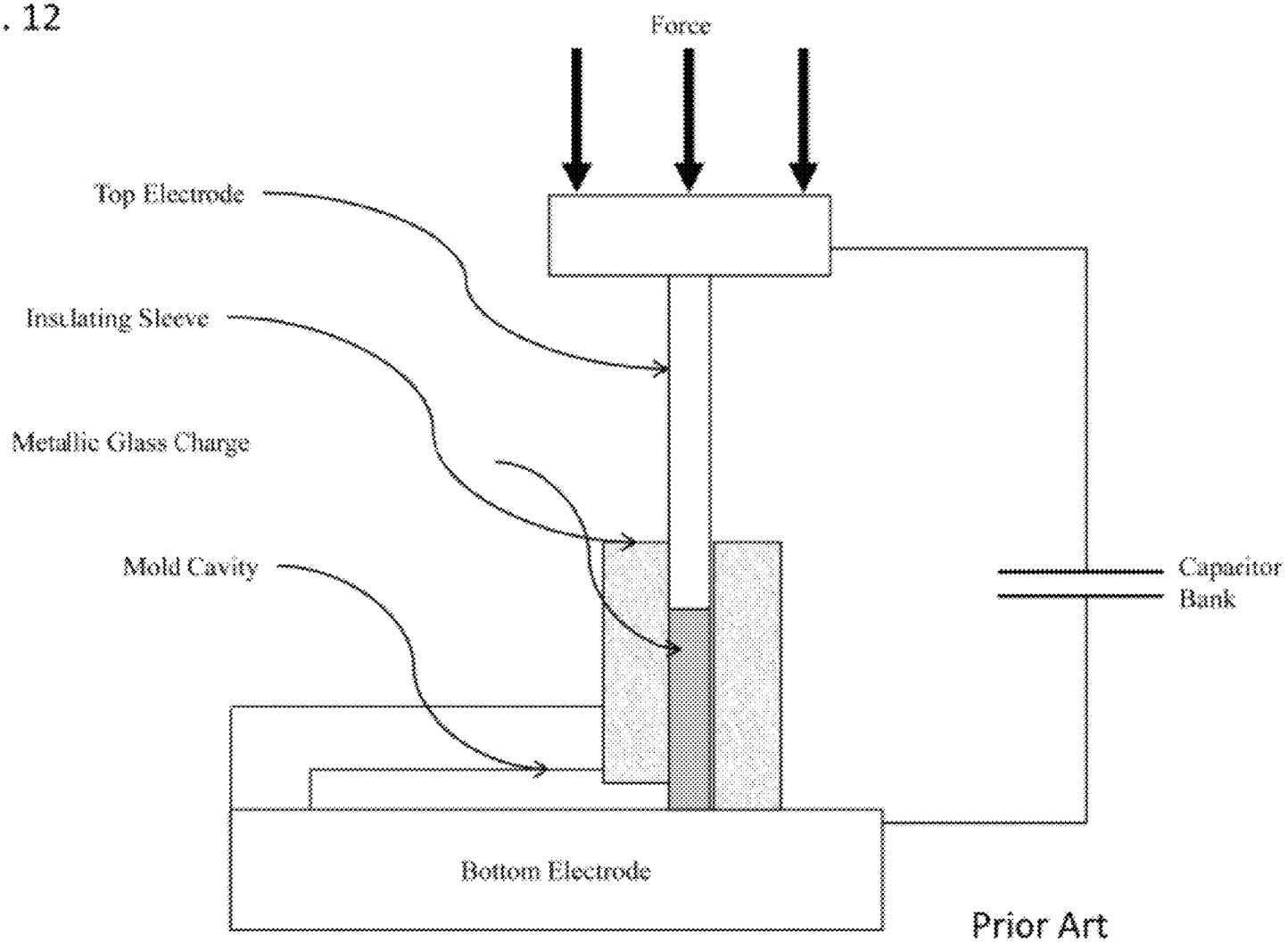
FIG. 12 provides a schematic of a conventional. RDFH mechanism.

A process technology that meets the requirements set forth in the instant invention, has been described in U.S. Patent Application No. 2009/0236017, which is incorporated into the present disclosure by reference. The technology utilizes the ultra-rapid heating and forming of a BMG alloy by a capacitor discharge to process BMG's in millisecond time scales at temperatures in the deeply undercooled liquid state (between about 350 and 750° C. for typical alloys of interest). A schematic of the technique is provided in FIG. 12.

Figure 13:
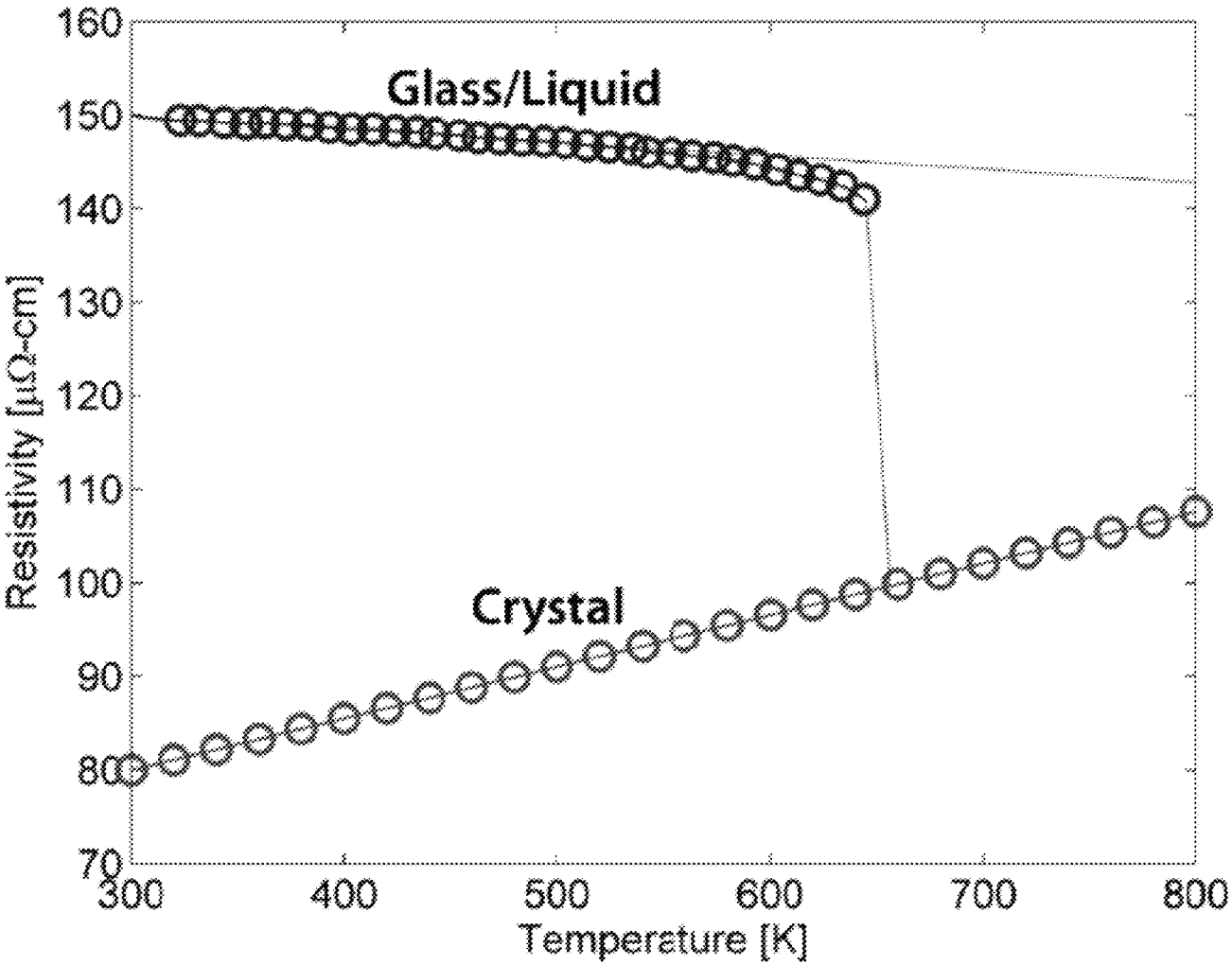
FIG. 13 provides a plot of resistivity vs. temperature for the BMG alloy Vitreloy 106 in its liquid/glass and crystalline state (taken from Mattern et al., *J. Non. Cryst. Sol.* 345&346, 758-761 (2004), the disclosure of which is incorporated herein by reference)

The technique relies on the unique electrical resistivity of BMGs, which, as shown in FIG. 13, remains nearly constant over the forming temperature range of interest. The result is that, unlike, conventional crystalline metals, BMGs heat uniformly and rapidly when electrical current is discharged across them. This means that the BMG can be uniformly heated in milliseconds up to the desired processing temperature even for thick samples. Accordingly, the process is sufficiently rapid to avoid crystallization of the BMG-forming liquid during the heating and shaping steps, even when applied to marginal glass forming alloys, such as Fe-based BMG's. Moreover, the processing method is extremely flexible, allowing BMG alloys to be injection-molded, blow molded, or compression molded under thermal and rheological conditions very similar to those employed in the forming of thermoplastic parts (e.g. polystyrene, polyethylene, etc.).

Example 1

Exemplary RDF High-Aspect Article Forming with Pd-Based BMG

Figure 14:
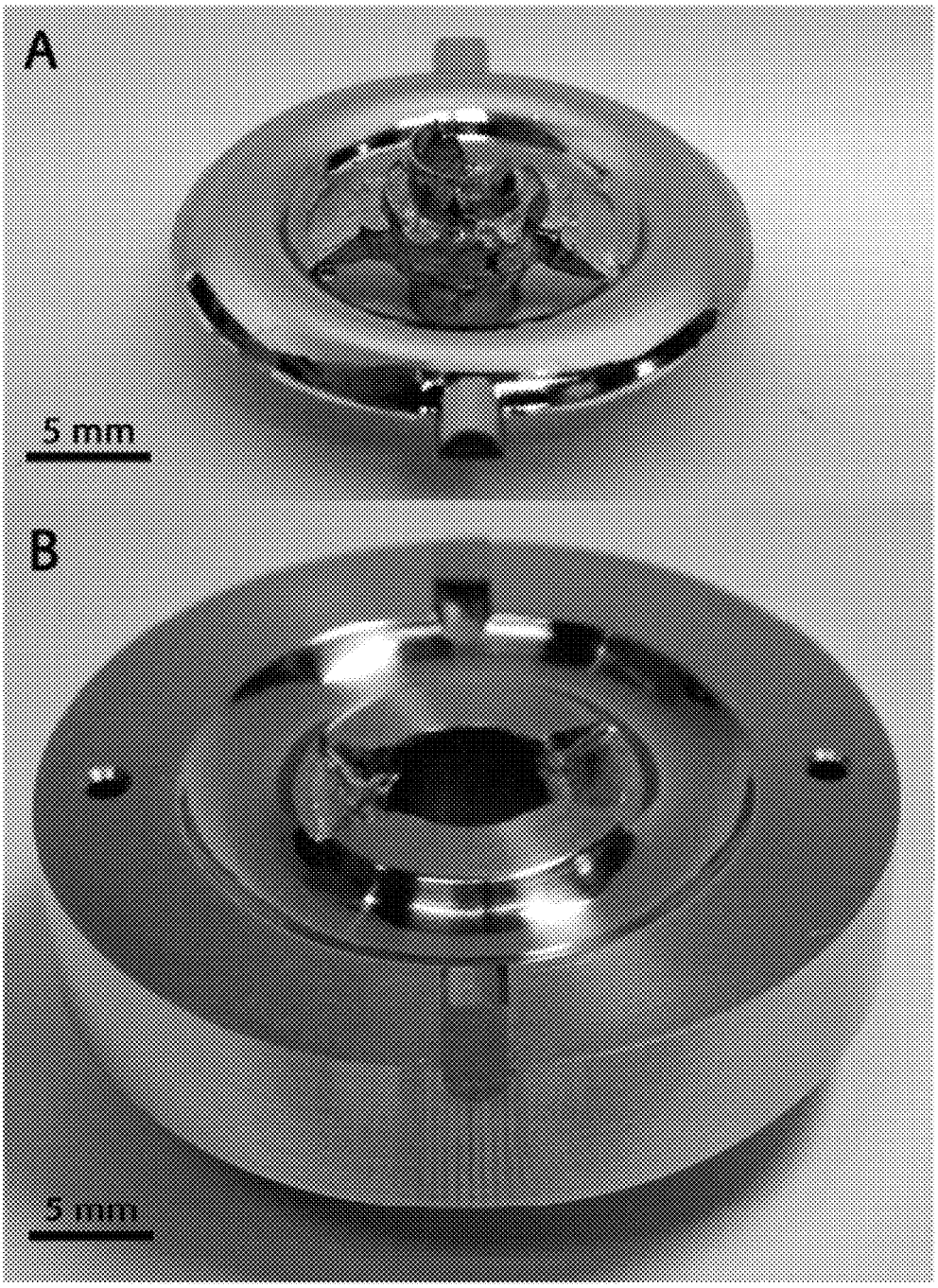
FIG. 14 provides images of an exemplary high aspect ratio part from a Pd-based BMG (A) together with the tool steel mold (B) made in accordance with the current invention.

As an example of a bulk high aspect ratio BMG structural component fabricated by the RDHF method, FIG. 14A shows a semi-torroidal net shaped component fabricated using the RDHF injection-molding method described above. FIG. 14B shows the mold-tool used to fabricate the part. The component was removed from the mold-tool with no subsequent finishing required. The precision net shape, high quality surface finish, and detail in the part are evident.

The part was produced from a Pd-based ($Pd_{43}Ni_{10}Cu_{27}P_{20}$) BMG with high Young's modulus (~100 GPa), high yield strength (1.6 GPa), high hardness (500 $Kg/mm^2$, Vicker's Hardness), by RDHF injection molding at a process temperature of about 450° C., process pressure of about 20 MPa, and total processing time (heating time of the initial rod-shaped BMG charge plus shaping time to obtain the net-shaped component) of about 50 milliseconds.

Example 2

Exemplary RDF High-Aspect Article Forming with Zr-Based BMG

As another example of a bulk high aspect ratio BMG structural component fabricated by the RDHF method, FIG. 1 shows a semi-torroidal net shaped component fabricated using the RDHF injection-molding method described above. The components are produced from a Zr-based (Vitreloy-105, $Zr_{52.5}Cu_{17.9}Ni_{14.6}Ti_5Al_{10}$) BMG at a process temperature of about 550° C., process pressure of about 20 MPa, and total processing time (heating time of the initial rod-shaped BMG charge plus shaping time to obtain the net-shaped component) of about 50 milliseconds. Aside from a few mild oxidation spots evident on the surface, a consequence of processing this part in open air, the part generally demonstrates precision net shape, high quality surface finish, and detailed features.

Figure 15:
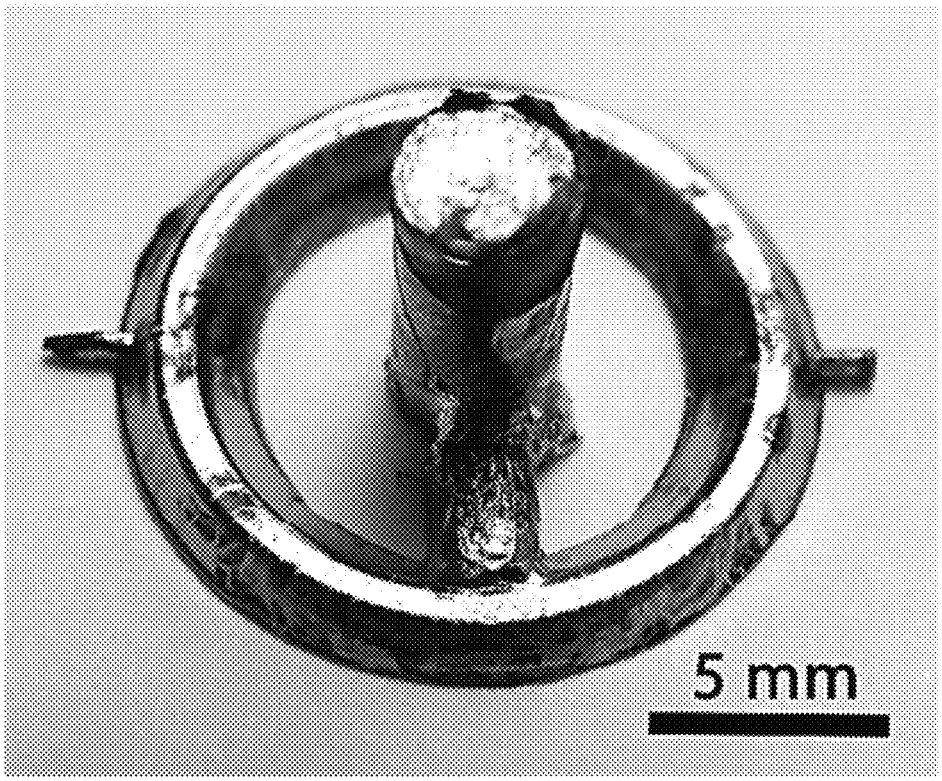
FIG. 15 provides images of an exemplary high aspect ratio part from a Zr-based BMG made in accordance with the current invention.

The Vitreloy 105 BMG has a melting temperature $T_m$ of about 820° C., and ΔT of about 50° C. If the part shown in FIG. 15 was to be produced by a conventional die casting method, the initial melt temperature should have been at least as high as 1100° C. in order to successfully produce an amorphous part. Such high temperature, which is far higher than the tempering temperature of a typical tool-steel mold, would rapidly degrade the mold tool, resulting in a very limited tool life. In the present invention, by contrast, the amorphous parts are produced at 550° C., which is below the tempering temperature of a typical tool-steel mold, and as such, it would promote long tool life. Furthermore, if the part shown in FIG. 15 was to be produced by a conventional glass-shaping method at $T<T_x$, the shaping pressure should have been extremely high, possibly approaching 1 GPa. This is because the Vitreloy 105 BMG has a very limited ΔT, and hence the viscosity at temperatures below $T_x$ is very high (at least as high as $10^7$ Pa-s). Such high pressures would be expected to rapidly deteriorate the mold tool, resulting in very short tool life.

Although specific examples of parts are provided and described above, it should be understood that any high aspect ratio part formed from a BMG material can be made in accordance with the current invention, including, for example, laptop computers, e-readers, tablet PCs, cell phones, pda's, digital cameras, video cameras, electronic measuring instruments, electronic medical devices, digital watches and time keeping devices, memory sticks and flash drives, televisions, MP3 players, video players, game consoles, check-out scanners, etc.

DOCTRINE OF EQUIVALENTS

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

What is claimed is:

1. A method of manufacturing an amorphous metal article comprising:

providing a blank from a bulk metallic glass;

heating the blank from the glass state to a processing temperature above the crystallization temperature, $T_x$, but below the melting temperature, $T_m$, of the bulk metallic glass, wherein the bulk metallic glass is heated substantially uniformly throughout the blank at a heating rate of at least 100° C./s to a the processing temperature wherein the viscosity of the bulk metallic glass is between 1and $10^5$ Pa-s;

applying a shaping pressure to the blank in a shaping tool to form an amorphous metallic article having a high aspect ratio of at least 100and dimensions in all axes of at least 0.5 mm; and quenching the article at a cooling rate sufficient to ensure that the article retains an amorphous phase.

2. The method of claim 1, wherein the bulk metallic glass is heated to a processing temperature where the product of the flow Weber number and the flow Reynolds number is less than one.

3. The method of claim 1, wherein the processing temperature is from between 400 and 750° C.

4. The method of claim 1, wherein the processing temperature is at least 100 degrees above the glass-transition temperature, $T_g$, and is at least 100 degrees below the melting temperature, $T_m$, of the bulk-solidifying amorphous alloy.

5. The method of claim 1, wherein the heating is performed at a heating rate in excess of the critical heating rate of the bulk metallic glass.

6. The method of claim 1, wherein the heating rate is at least 100 ° C./s.

7. The method of claim 1, wherein the shaping pressure is no greater than 100 MPa.

8. The method of claim 1, wherein the shaping pressure is from 10 to 50 MPa.

9. The method of claim 1, wherein the flow velocity of the bulk metallic glass into the shaping tool is less than 1 m/s.

10. The method of claim 1, wherein the entire shaping step occurs in less than 50 ms.

11. The method of claim 1, wherein the article has dimensions in all axes of at least 1 mm.

12. The method of claim 1, wherein the processing temperature is at least 50° C. lower than the tempering temperature of the shaping tool.

13. The method of claim 1, wherein the shaping tool has a cycle life of at least $10^6$ shaped articles.

14. The method of claim 1, wherein the outer surface of the article is formed free of visible defects.

15. The method of claim 13, wherein the bulk metallic glass is selected from the group consisting of metallic glass forming alloys Ti-based, Cu-based, Zr-based, Au-based, Pd-based, Pt-based, Ni-based, Co-based, and Fe-based alloys.

16. The method of claim 1, wherein the article is in the form of an electronics case for a device selected from the group of: cellular phone, PDA, portable computer, and digital camera.

17. The method of claim 1, wherein the article is made in net-shape such that no post-processing is required.

18. The method of claim 1, wherein the article is formed free of defects including at least one of the group consisting of flow lines, gas inclusions, foreign debris and roughening.

19. The method of claim 1, wherein the heating occur through a discharge of electrical current through the blank.

* * * * *